US008206182B2

(12) United States Patent
Kuo et al.

(10) Patent No.: US 8,206,182 B2
(45) **Date of Patent: *Jun. 26, 2012**

(54) ELECTRICAL CONNECTOR

(75) Inventors: Peter Kuo, Tu-Cheng (TW); Chin-Pao Kuo, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/964,723

(22) Filed: Dec. 9, 2010

(65) Prior Publication Data

US 2011/0143604 A1 Jun. 16, 2011

(51) Int. Cl.
*H01R 24/00* (2006.01)

(52) U.S. Cl. ..... 439/676

(58) Field of Classification Search ..... 439/660, 439/676, 357, 852, 862, 752, 748, 857, 733.1, 439/224

See application file for complete search history.

(56) References Cited

U.S. PATENT DOCUMENTS

| | | | | |
|---|---|---|---|---|
| 5,833,500 | A * | 11/1998 | Mahon et al. | 439/852 |
| 6,171,126 | B1 * | 1/2001 | Wu et al. | 439/224 |
| 7,056,146 | B2 | 6/2006 | Hiramoto et al. | |
| 7,422,451 | B2 * | 9/2008 | Chen et al. | 439/101 |
| 2003/0236035 | A1 * | 12/2003 | Kuroda et al. | 439/857 |

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector (100), comprising an insulative housing (1) defining a base portion (11) and a mating portion (12) extending from the front side of the base portion along a mating direction; a plurality of passageways (114) disposed in the base portion with an opening backwards and extending along the mating direction; a plurality of receiving spaces (121) disposed in the mating portion and communicating with the complementary passageways; a plurality of contacts (2) mounting to the insulative housing along the mating direction, and each contact including a flat base part (21) mounting to the base portion of the insulative housing, a connecting part (22) extending forwards from the base portion and received in the passageways, a mating part (23) extending from the connecting part and disposed in said receiving space, and a spacer part (24) located between the base part and the connecting part; wherein the spacer part covers the opening of the passageways.

19 Claims, 6 Drawing Sheets

ELECTRICAL CONNECTOR

BACKGROUND OF THE INVENTION

1. Field of the Invention

The present invention relates generally to an electrical connector, and more particularly to an electrical connector with improved contacts. This application relates to a copending application claiming priority of TW 98223174 filed Dec. 10, 2009 and having the same title, the same applicants and the same assignee with the instant invention.

2. Description of the Prior Art

A connector to be attached to an insulated wire defines a resin housing and a contact (terminal metal fitting) secured to the housing. An IDC contact is featured with a slot in which when a conductive wire is disposed within the slot, insulative jacket of the conductive wire be pierced through by edges of the slot. As a result, not only will the conductive wire be held therein, electrical interconnection between the IDC contact and the conductor within the wire is also established. When such an insulation displacement contact is used, the contact and the core wire portion of the insulated wire can be electrically connected to each other merely by pushing the insulated wire into the slot of the insulation displacement contact. A connector using such an insulation displacement contact is called an insulation displacement connector. U.S. Pat. No. 7,056,146 issued to Hiramoto on Jun. 6, 2006 discloses a connector utilizing the IDC contact terminal which is arranged such that the conductive wires is in alignment with the mating direction, see FIGS. 1, 4 and 8 of this patent. According to the disclosure, the diameter of the conductive wire is limited while the length of the slot is fixed, besides, the kind of contacts usually defines a very small size. Obviously, it requires more precision in the manufacturing process and it's difficult for the producer to manufacture exactly.

Hence, in this art, a contact to overcome the above-mentioned disadvantages of the prior art should be provided.

BRIEF SUMMARY OF THE INVENTION

A primary object, therefore, of the present invention is to provide an electrical connector, which defines improved contacts soldering with cables.

In order to implement the above object, an electrical connector comprising: an insulative housing defining a base portion and a mating portion extending from the front side of the base portion along a mating direction; a plurality of passageways disposed in the base portion with an opening backwards and extending along the mating direction; a plurality of receiving spaces disposed in the mating portion and communicating with the complementary passageways; a plurality of contacts mounting to the insulative housing along the mating direction, and each contact including a flat base part mounting to the base portion of the insulative housing, a connecting part extending forwards from the base portion and received in the passageways, a mating part extending from the connecting part and disposed in said receiving space, and a spacer part located between the base part and the connecting part; wherein the spacer part covers the opening of the passageways.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
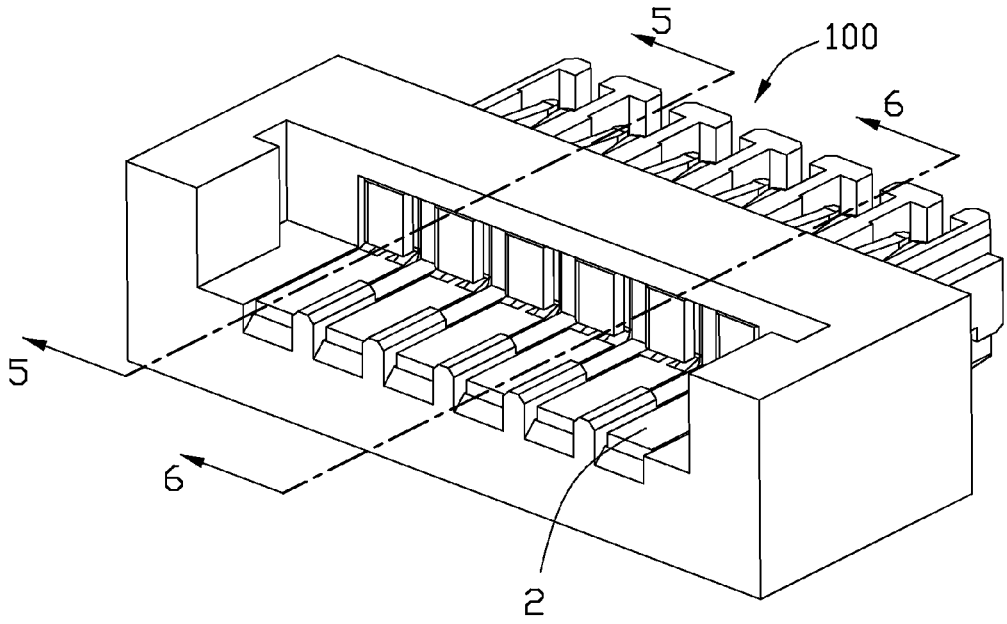
FIG. 1 is a perspective view illustrating a preferred embodiment of an electrical connector in according with the present invention.
Figure 2:
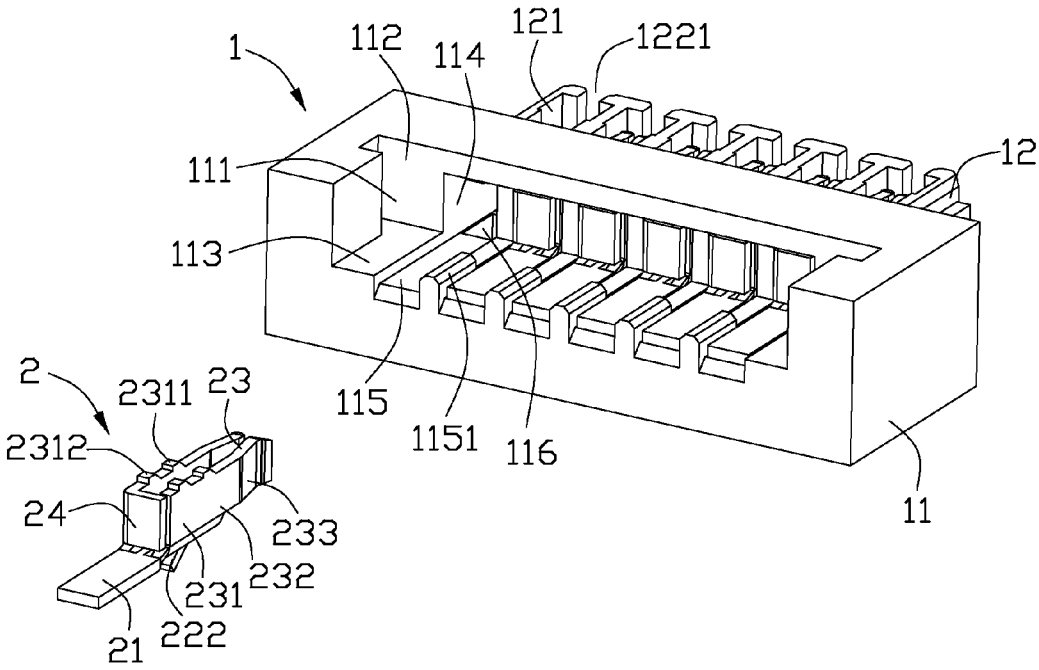
FIG. 2 is a perspective view of FIG. 1, but one contact separated from the electrical connector.
Figure 3:
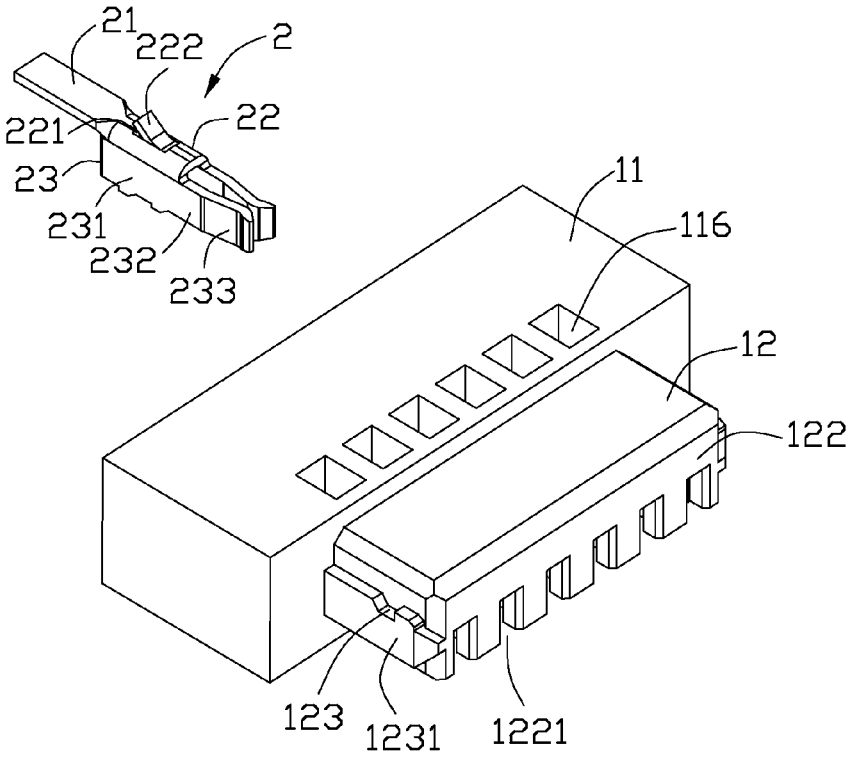
FIG. 3 is a view similar to FIG. 2, but viewed from another angle.
Figure 4:
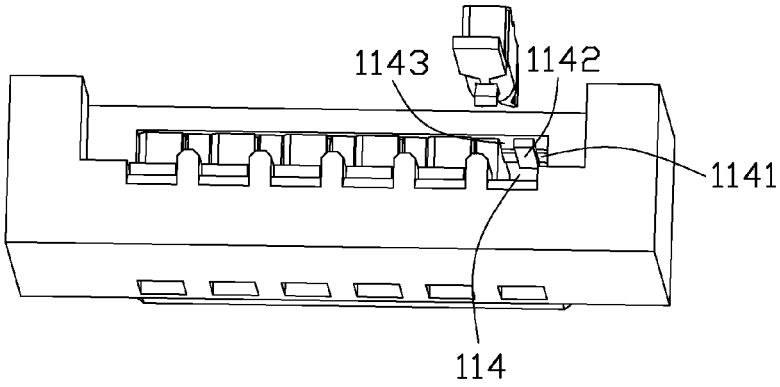
FIG. 4 is a view similar to FIG. 2, but viewed from another angle.
Figure 5:
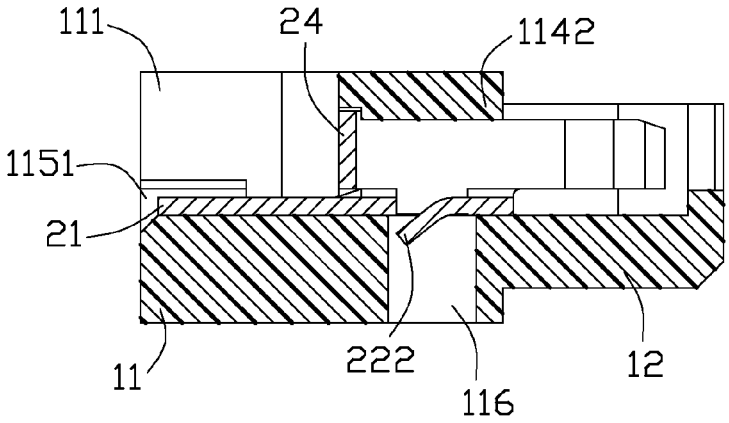
FIG. 5 is a section view illustrating the contact and the housing fitted to each other along 5-5 line.
Figure 6:
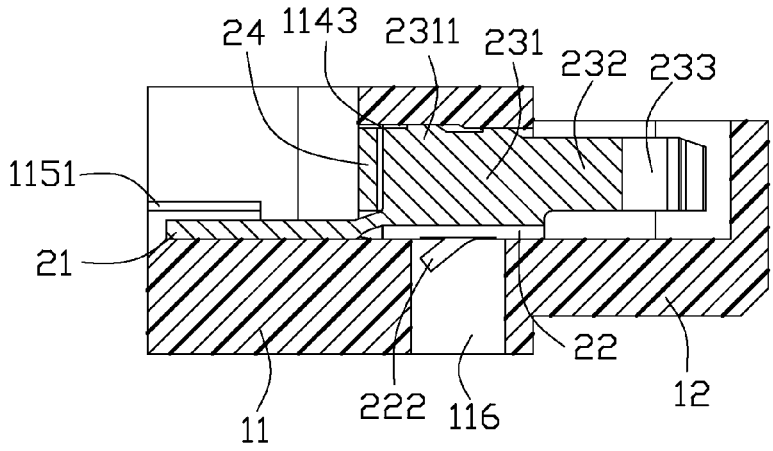
FIG. 6 is a section view illustrating the contact and the housing fitted to each other along 6-6 line.

Reference to FIGS. 1 to 6, an electrical connector 100 in according with a preferred embodiment of the present invention is shown. The electrical connector 100 comprises an insulative housing 1 and a row of contacts 2 received in the housing 1.

The insulative housing 1 includes a base portion 11 and a mating portion 12 extending from the front side of the base portion 11 along a mating direction. In this embodiment, the mating direction is from back to front.

The base portion 11 defines an rectangular configuration and defines a receiving space 111 communicating with the outside. The receiving space 111 is formed by a front wall 112, a bottom wall 113 and a pair of side walls (unlabeled). A row of passageways 114 are running through the front wall 112 along the mating direction. The bottom wall 113 defines a row of rectangular channels 115 communicating with the complementary passageways 114. A spacer 1151 is disposed between each two adjacent channels 115. A plurality of slots 116 run through the bottom wall 113 along a direction vertical to the mating direction and communicate with the complementary passageways 114. Each passageway 114 defines an opening backwards and defines a top wall 1141, a pair of side walls and a convex rib 1142. The rib 1142 is disposed on the inner side of the top wall 1141 and extending along the mating direction. The rib 1142 forms a pair of grooves (unlabeled) with the pair of side walls. Each of the grooves defines a step portion 1143 defining a higher back portion and a lower front portion (unlabeled).

The mating portion 12 of the insulative housing 1 defines a number of receiving space 121 for receiving contacts 2 and communicating with the complementary passageways 114. Each of the receiving space 121 is opening upwards. The mating portion 12 defines a front wall 122 with a number of outlets 1221 communicating with the receiving space 121 for mating with the contacts of the complementary connector. The mating portion 2 further defines a pair of guiding arms 123 disposed on the two sides of the mating portion 2 and extending along the mating direction. A notch 1231 is disposed on each guiding arm 123 for locking with the complementary connector and avoiding the contacts 2 inserting into the passageways 114 along a wrong direction.

Reference to FIGS. 2 to 6, the contact 2 is made from conductive material stamped from sheet metal and comprises a flat base part 21 for soldering cables, a connecting part or retention part 22 extending forwards from the base part 21, a pair of mating parts 23 extending from the two sides of the connecting part 22, and a spacer part 24 locating between the base part 21 and the mating part 22. The base part 21 is disposed in the channel 115 of the insulative housing 1. A rectangular hole 221 is disposed on the connecting part 22, and a spring tab 222 extending from the front edge of the hole 211 slantways and backwards into the slot 116 of the insulative housing 1. The tab 222 engages with the insulative housing 1 for ensuring the contact 2 stably retained in the insulative housing 1.

The mating part 23 passes through the passageway 114 into the receiving space 121 of the insulative housing 1. The mating part 23 defines a pair of vertical arms 231 extending upwards from the connecting part 22 along a direction vertical to the base part 21, a pair of connecting arms 232 extending forwards from the vertical arms 231 along the mating direction and a pair of curved touching arms 233 extending forwards from the connecting arms 232. The pair of touching arms 233 firstly extend along a direction close to each other and then extend along a direction away from each other, and the two touching arms 233 define a closest distance which could just allow the complementary contact inserting in. The pair of vertical arms 231 is received in the passageway 114 of the insulative housing 1 with the rib 1142 locating between the two vertical arms 231.

A first tab 2311 and a second tab 2312 are disposed on the top side of each vertical arm 231. The first tab 2311 is in front of and lower than the second tab 2312. The first tab 2311 and the second tab 2312 respectively engage with the lower front portion and the higher back portion of the step portion 1143 of the insulative housing 1 for preventing the contact 2 inserting unduly into the passageway 114.

The width and the height of the contacts 2 is similar with the passageways 114 of the insulative housing 1. The spacer part 24 of the contact 2 is a rectangular plate extending from the back edge of one of the vertical arms 221 to the other vertical arm 221. The spacer part 24 receives in the back end of passageway 114 and is adjacent with the rib 1142. The spacer part 24 defines a same width and a same height with the back opening of the passageway 114 so that the spacer part 24 could cover the opening The spacer part 24 is used for preventing the solder during the soldering process and the material during the molding process flowing into the passageways 114 and the receiving space 121, and protecting the mating part 23 of the contact 2.

In assembly, firstly a row of contacts 2 are inserted into the receiving space 121 through the passageways 114 along the mating direction. Secondly, use glue to position the base part 21 of the contact 2 to the base portion 11 of the insulative housing 1. Thirdly, solder the cable to the base part 21. According to the present invention, the diameter of the cable may not be limited because the cable is soldered on the contact 2. It is easy to manufacture the contact 2 for the producer.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector, comprising:

an insulative housing defining a base portion and a mating portion extending from the front side of the base portion along a mating direction;

a plurality of passageways disposed in the base portion, each of the passageways defining an opening backwards and extending along the mating direction;

a plurality of receiving spaces disposed in the mating portion and communicating with the complementary passageways;

a plurality of contacts mounting to the insulative housing along the mating direction, and each contact including a flat base part mounting to the base portion of the insualtive housing, a connecting part extending forwards from the base portion and received in the passageways, a mating part extending from the connecting part and disposed in said receiving space, and a spacer part located between the base part and the connecting part; wherein said mating part of the contact defines a pair of vertical arms extending upwards and vertically from the connecting part of the contact; wherein said passageway extends along the mating direction and defines a top wall with a rib disposed on the inner side of the top wall, said rib extends along the mating direction and locates between said two vertical arms; wherein the spacer part covers the opening of the corresponding passageway.

2. The electrical connector as claimed in claim 1, wherein said mating part of the contact further defines a pair of connecting arms extending forwards from the vertical arms along the mating direction and a pair of curved touching arms extending forwards from the connecting arms.

3. The electrical connector as claimed in claim 2, wherein said connecting part and the vertical arms are retained in the passageways of the insulative housing.

4. The electrical connector as claimed in claim 3, wherein said connecting part defines a rectangular hole and a spring tab extending from the front edge of the hole slantways and downwards, the base portion of the insulative housing defines a slot extending along a direction vertical to the mating direction and communicating with the passageways for engaging with said spring tab.

5. The electrical connector as claimed in claim 4, wherein said base part of the contact is retained to the second base of the insulative housing by glue.

6. The electrical connector as claimed in claim 1, wherein said base portion defines a plurality of channels receiving the base part of the contact, and a spacer is disposed between each two adjacent channels.

7. The electrical connector as claimed in claim 1, wherein said spacer part is a rectangular metal plate extending from the back edge of one of the vertical arm to the other vertical arm along a direction vertical to the vertical arms.

8. The electrical connector as claimed in claim 7, wherein said spacer part of the contacts are disposed in the passageways of the insulative housing and adjacent with said rib.

9. The electrical connector as claimed in claim 8, wherein said spacer part defines a same width and a same height with the passageway.

10. The electrical connector as claimed in claim 1, wherein said top wall, two side walls and the rib together form two grooves, and each groove defines a step portion defining a lower front portion and a higher back portion.

11. The electrical connector as claimed in claim 10, wherein each vertical arm of the contact defines a front first tab and a back second tab protruding upwards from the top side of the vertical arm, the first tab is lower than the second tab, and the first tab is engaging with the lower front portion when the second tab engaging with the higher back portion of the step portion.

12. The electrical connector as claimed in claim 1, wherein said contacts are arranged in a row along the horizontal direction.

13. An electrical connector comprising:

an insulative housing defining a base portion and a mating portion forwardly extending from the base portion, said base portion defining an L-shaped cross-section and having a front vertical base from which said mating portion extends, and rear horizontal base;

a plurality of passageways formed in the front vertical base of the base portion along a front-to-back direction;

a plurality of receiving spaces formed in the mating portion along said front-to-back direction and in alignment with the corresponding passageways, respectively;

a plurality of contacts disposed in the corresponding passageways, respectively, each of said contacts defining a front mating section disposed in the corresponding receiving space, and a rear base part mounted upon the horizontal base and exposed vertically for soldering to a corresponding wire; wherein each of said contacts defines a retention section located between the front mating section and the rear base part and equipped with upward and downward protrusions for engagement with the housing at two opposite positions in a vertical direction perpendicular to said front-to-back direction; wherein each of said contacts includes a spacer part forwardly shielding the corresponding passageway for avoiding contamination after the corresponding contact is fully assembled into the housing.

14. The electrical connector as claimed in claim 13, wherein said spacer part defines a forward surface having a first side edge region directly forwardly confronting the retention section, and a second side edge region directly forwardly confronting the housing.

15. The electrical connector as claim 14, wherein the receiving spaces are upwardly exposed to an exterior.

16. The electrical connector as claimed in claim 13, wherein a plurality of slots are formed in the front vertical base into which the corresponding downward protrusions extend, respectively.

17. The electrical connector as claimed in claim 16, wherein each of said slots extends through the front vertical base downwardly.

18. The electrical connector as claimed in claim 13, wherein the rear horizontal base defines a plurality of channels to receive corresponding rear base parts, respectively.

19. An electrical connector comprising:

an insulative housing defining a base portion and a mating portion forwardly extending from the base portion, said base portion defining an L-shaped cross-section and having a front vertical base from which said mating portion extends, and rear horizontal base;

a plurality of passageways formed in the front vertical base of the base portion along a front-to-back direction;

a plurality of receiving spaces formed in the mating portion along said front-to-back direction and in alignment with the corresponding passageways, respectively;

a plurality of contacts disposed in the corresponding passageways, respectively, each of said contacts defining a front mating section disposed in the corresponding receiving space, and a rear base part mounted upon the horizontal base and exposed vertically for soldering to a corresponding wire; wherein each of said contacts defines a retention section located between the front mating section and the rear base part; wherein a spacer part defines a forward surface having a first side edge region directly forwardly confronting the retention section, and a second side edge region directly forwardly confronting the housing.

* * * * *